US005791490A

United States Patent [19]

Heinemann et al.

[11] Patent Number: 5,791,490

[45] Date of Patent: Aug. 11, 1998

[54] SEPARATOR FOR PARTICULATE MATERIALS

[75] Inventors: Otto Heinemann, Ennigerloh; Ingo Engeln; Hubert Eickholt, both of Beckum; Ludger Lohnherr, Oelde-Sunninghausen; Michael von Seebach, Ennigerloh; Ludger Schulte, Ahlen, all of Germany

[73] Assignee: Krupp Polysius AG

[21] Appl. No.: 779,800

[22] Filed: Jan. 7, 1997

[30] Foreign Application Priority Data

Feb. 22, 1996 [DE] Germany ..... 196 06 672.7

[51] Int. Cl.[6] ..... B07B 07/08

[52] U.S. Cl. ..... 209/148; 209/135

[58] Field of Search ..... 55/404, 405, 408; 209/135, 148, 146, 147

[56] References Cited

U.S. PATENT DOCUMENTS

| | | | |
|---|---|---|---|
| 1,810,922 | 6/1931 | Mills | 55/404 |
| 3,273,325 | 9/1966 | Gerhold | 55/405 |
| 3,371,783 | 3/1968 | Meyer et al. | 209/135 |
| 4,792,393 | 12/1988 | Blasczyk et al. | 209/135 |
| 5,496,394 | 3/1996 | Nied | 55/408 |

FOREIGN PATENT DOCUMENTS

| | | | |
|---|---|---|---|
| 3533484 | 3/1987 | Germany | 209/148 |
| 2947310 | 5/1987 | Germany . | |
| 3622413 | 8/1995 | Germany . | |

*Primary Examiner*—Jay H. Woo
*Assistant Examiner*—Robert Hopkins
*Attorney, Agent, or Firm*—Reising, Ethington, Learman & McCulloch, PLLC

[57] ABSTRACT

The invention relates to a separator comprising a separator housing with an inlet spiral for separating air which opens tangentially into an annular separating chamber and is divided into a plurality of delivery channels which lie one above the other, as well as a basket-shaped separator rotor disposed centrally and with a vertical axis in the separator housing and a guide vane ring which surrounds the latter with a radial clearance. In order that this separator on the one hand has a high effectiveness of separation between oversize material and fine material and on the other hand facilitates a sufficiently broad grain size distribution of the fine material, the overall shape of the separator rotor is that of a cone which tapers downwards.

12 Claims, 4 Drawing Sheets

Fig, 2
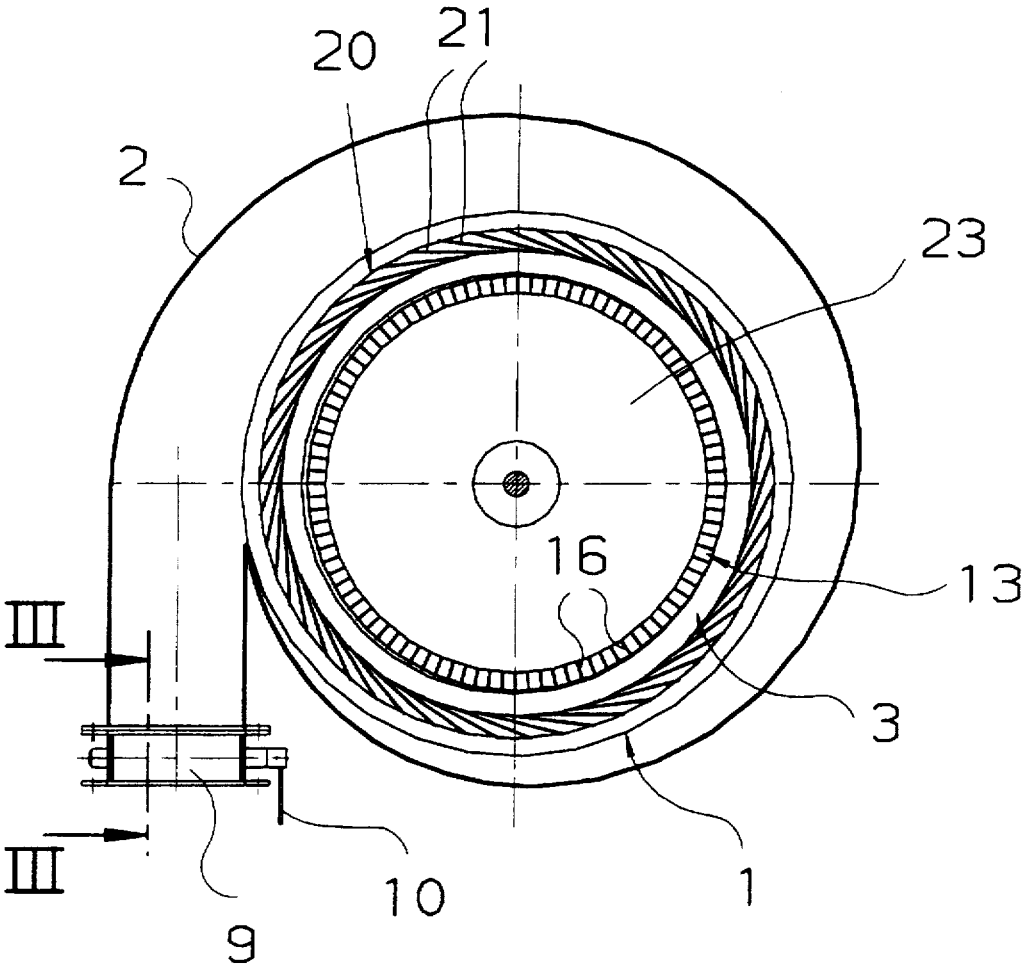
Fig, 3
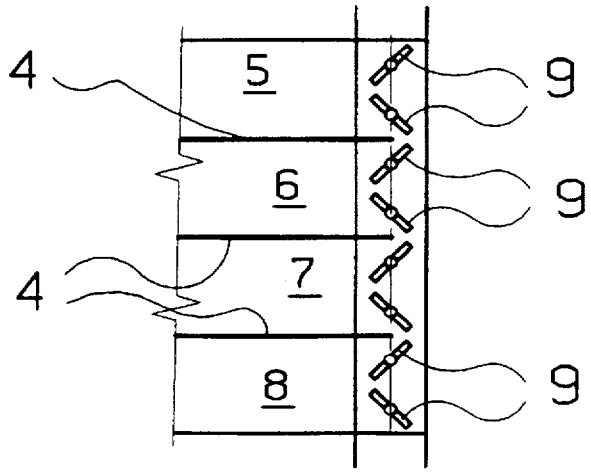

SEPARATOR FOR PARTICULATE MATERIALS

This invention relates to a separator for the pneumatic separation of relatively coarse and relatively fine particulate materials.

BACKGROUND OF THE INVENTION

A separator of the general class to which the invention relates is disclosed in DE-C-36 22 413 and is used as a high-capacity separator or high-capacity air separator in grinding installations in order to separate the comminuted product coming from a mill, e.g. cement materials or the like, into fine material which is to be drawn off as finished material and oversize material (tailings) which is generally passed on for further comminution. This known separator is constructed in such a way that it has a high selectivity. In this case a construction is chosen in which the separator rotor with a vertical axis is disposed centrally in the separator housing and has a substantially cylindrical shape (about the rotor axis), this separator rotor being surrounded with a radial clearance by a stationary guide vane ring, which is also substantially cylindrical, in such a way that a separating chamber in the form of an annular cylinder is formed between the rotor blades of the separator rotor and the guide vane ring. Furthermore, the inlet spiral for delivering the separating air is divided by partitions into at least two, preferably three delivery channels which lie one above the other and in each of which setting elements are provided. In this way the separating air flowing into the individual delivery channels of the inlet spiral can be adapted in quantity and/or speed to the material loading in the different regions of the height of the separating chamber with a view to the desired high selectivity.

When this known separator operates in a grinding installation in a closed circuit with a corresponding mill, particularly a roller grinding mill or a roll mill such as for example a material bed roll mill, then it may happen that the resulting finished product, for example cement, has a relatively steep grain size distribution and thus a relatively narrow grain size range. However, in practice it is often necessary to produce many fine materials which are to be drawn off as finished material with a broader or shallower grain size distribution, as is required in the case of many cements for various reasons.

A separator is disclosed in DE-A-29 47 310 in which the upper housing portion is of cylindrical construction without an inlet spiral for the separating air. A classifier fan impeller which operates as a separator rotor with a vertical axis of rotation is disposed centrally in this upper housing portion and may have the shape of an inverted cone or any other shape. A type of guide vane ring is disposed with a radial clearance around this fan impeller so that again a separating chamber is formed between the guide vane ring and the fan impeller. Here too the aim is for classification with a high degree of efficiency, and also what is sought above all is a complete separation of oversize and fine particles in the event of agglomerate formation or the like. For this purpose separating air is passed by way of a plurality of gas chambers into the interior of the separator, these gas chambers being distributed over the height of the separator housing, only the uppermost gas chamber surrounding the actual separating chamber between the separator rotor and the guide vane ring whilst the other gas chambers open into the interior of the separator housing in the region below this actual separating chamber. In this way, of the material for separation which can be delivered centrally from below or from the side or from above, above all the oversize material falling downwards is subjected a number of times to further separation or pneumatic screening. Since in the annular separating chamber surrounding the separator rotor separating air is only delivered to the uppermost gas chamber (or the uppermost gas inlet channel), but the quantity and composition of the material to be separated is generally very variable over the height, the separating air will be distributed in a correspondingly irregular and uncontrolled manner over the height of the separating chamber at the expense of the desired sharp selectivity.

The object of the invention is to make further improvements to a separator of the type referred to in such a way that whilst retaining a high degree of effectiveness of separation between oversize and fine material it permits the production of a finished product which is adjustable within wide limits in the breadth of its grain size distribution and also facilitates a sufficiently broad or shallow grain size distribution.

SUMMARY OF THE INVENTION

In the separator construction according to the invention the separator rotor has a conical shape which tapers downwards with rotor blades which extend obliquely downwards and inwards.

Since in this separator construction according to the invention the inlet spiral for the separating air is also divided into at least two delivery channels which lie one above the other, in order to be able to deliver the separating air in a targeted and adapted manner to the different heights or levels of the separating chamber at least in adjustable quantities, here too the possibility is retained of classifying the material for separation very selectively However, the separator rotor which tapers conically downwards and therefore because of its greater diameter in the upper region it produces a correspondingly higher circumferential speed there, which in turn leads to a correspondingly high turbulence at this level in the separating chamber and to a small cut size. On the other hand, at the lower level in the separating chamber, because of the smaller diameter of the separator rotor correspondingly lower circumferential speeds are produced with correspondingly lower turbulence, which leads to a larger cut size. Thus because of these differing turbulent motions over the height of the separating chamber different cut sizes can be achieved in the various levels over the height of the separating chamber, so that—by comparison with the known separator according to DE-C-36 22 413 which was described in the introduction—a high effectiveness of separation between oversize and fine material is achieved in each of the individual levels, but at the same time the possibility is created of achieving or setting a broad or shallow grain size distribution which corresponds to the particular requirements.

In this separator construction according to the invention it is also advantageous to provide a configuration of the individual delivery channels of the inlet spiral or corresponding means such that larger quantities of separating air are delivered to the upper levels of the separating chamber which are delimited towards the interior by upper rotor portions with a larger external diameter than to the lower regions (levels) of the separating chamber which are delimited towards the interior by lower rotor portions with a smaller external diameter. Therefore in the upper levels of the separating chamber the separator rotor has higher circumferential speeds with—preferably adjustable—relatively high quantities of separating air in order to achieve a relatively small cut size. On the other hand, smaller—preferably adjustable—quantities of separating air can be delivered into the lower levels with the lower circumferential speeds of the separator rotor, and in this coarser cut size range a relatively clear separation is also facilitated. Thus overall the separating air through the delivery channels can be adjusted in quantity and speed and thus the turbulent motion can be adjusted over the entire height of the separating chamber so that a plurality of cut sizes can be achieved over a relatively broad range without the separator losing any selectivity.

The use of this separator according to the invention is notable for being particularly advantageous when it is connected in a closed grinding circuit together with a material bed roll mill which is known per se in order to comminute cement clinker and additives, wherein the fine material to be drawn off from the separator as finished material then forms a cement with correspondingly broader or shallower grain size distribution. However, other materials can also be comminuted and separated in a similar manner, in which case another mill, e.g. a conventional roller grinding mill or roll mill can also be used for comminution of the material to be delivered to the separator.

THE DRAWINGS

The invention will be explained in greater detail with reference to some embodiments which are illustrated in the drawings, in which:

FIG. 2 shows a horizontal cross-section through the separator according to the invention, approximately corresponding to the section line II—II in FIG. 1;

FIG. 3 shows a sectional detail view corresponding to the line III—III in FIG. 2 explaining setting devices in separating air delivery channels;

DETAILED DESCRIPTION

Figure 1:
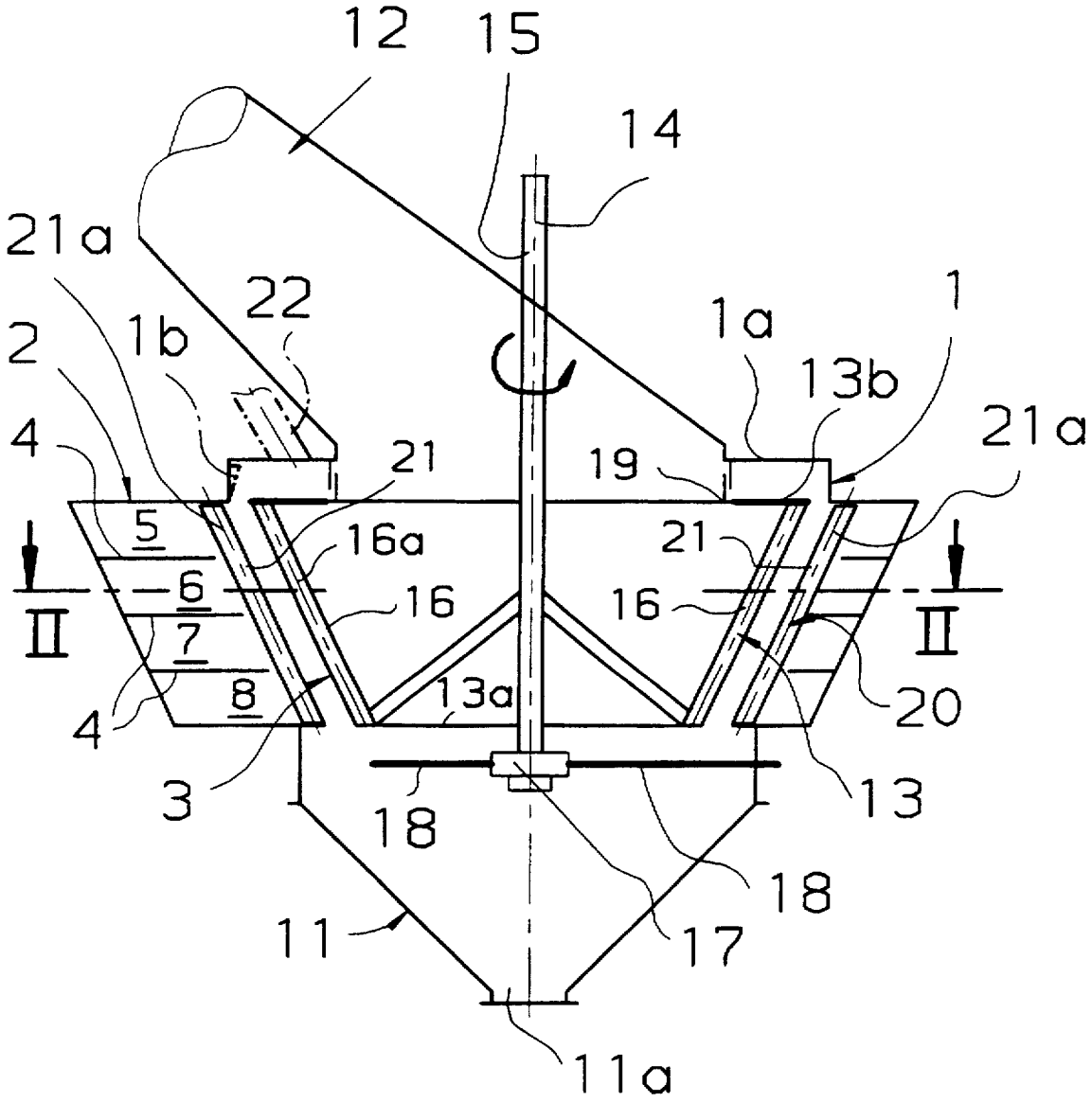
FIG. 1 shows a vertical cross-section through a first embodiment of the separator according to the invention.

The separator according to the invention will be explained first of all with reference to a first embodiment which can be seen principally from FIG. 1 but also to a large extent from FIG. 2.

This separator comprises a separator housing 1 which has a vertical axis and has in its upper region an inlet spiral 2 for the delivery of separating air. This inlet spiral 2 opens tangentially into an annular separating chamber 3 constructed within the separator housing 1. In this example (FIG. 1) this inlet spiral 2 is also divided by horizontal partitions 4 into four separating air delivery channels 5, 6, 7, 8 which lie one above the other and in the present case have substantially the same dimensions as regards height.

As can be seen from FIGS. 2 and 3, two setting devices constructed as adjustable flaps 9 for setting the quantity of air delivered to the individual delivery channels 5, 6, 7, 8 are installed in the inlet region of the inlet spiral. The flaps 9 are disposed in pairs and can be actuated by way of corresponding outer adjusting levers 10, and indeed the flaps 9 which are associated with the individual delivery channels 5, 6, 7, 8 can each be set independently of one another. Thus a desired adjustable quantity of separating air can be delivered to each of the different levels of the separating chamber 3.

The separator housing 1 also has at its lower end a tailings discharge hopper 11 with a tailings outlet opening 11*a* as well as at least one pipe connection 12 which serves for discharging the separating air laden with fine material and in this case (cf. FIG. 1) is connected to the upper covering wall 1*a* of the housing 1.

A separator rotor 13 which is shaped approximately like a basket and is rotatable about a vertical axis 14 is disposed centrally in the separator housing 1 and is driven by way of a shaft 15 by a drive mechanism which is not shown in greater detail and is disposed on the separator housing 1. This rotor 13 is equipped on its circumference with rotor blades 16 which can be mounted on the rotor in the usual way and can preferably be stationary but can also if required be fixed on the separator rotor 13 so that they are adjustable about their longitudinal axes 16*a* (FIG. 1) which extend from top to bottom.

It is important, however, in this case that the separator rotor 13 has a conical shape which tapers downwards from the top (cf. FIG. 1) with rotor blades 16 extending obliquely downwards and inwards.

Otherwise this rotor 13 can essentially be constructed in the conventional manner, its shaft 15 being advantageously mounted in a bearing 17 which is supported in an adjustable manner by radial struts 18.

In this embodiment according to FIG. 1 the separator rotor 13 is closed on its lower end face by a base wall 13*a* whilst at its upper end it is only partially covered by an annular plate 13*b* so that on this upper face it has a sufficiently large central opening 19 for discharging the separating air laden with fine material into the pipe connection 12.

The separator rotor 13 is also concentrically surrounded with a radial clearance by a guide vane ring 20 in such a way that the annular separating chamber 3 is formed between this guide vane ring 20 and the rotor blades 16. This guide vane ring 20 contains a plurality of guide vanes 21 which are disposed equidistantly from one another in the circumferential direction and can preferably be adjusted together (by means which are known per se) relative to the separating chamber 3 about their longitudinal axes 21*a* which extend from top to bottom. Thus this guide vane ring 20 or the guide vanes 21 thereof is/are provided at the outlet end of the inlet spiral 2 for the separating air. In this case the guide vanes 21—as shown in FIG. 2—are inclined in the flow direction of the separating air flowing approximately tangentially into the separating chamber 3. This separating chamber 3 also extends substantially over the same (vertical) height as the inlet spiral 2, the guide vane ring 20 and the separator rotor 13 or the rotor blades 16 thereof.

According to the embodiment illustrated in FIG. 1 the guide vane ring 20 also has conical shape which tapers downwards, and accordingly the guide vanes 21 extend obliquely from above downwards and inwards or converge. The guide vane ring 20 tapers at substantially the same cone angle (based on the axis of rotation 14) as the separator rotor 13. In this way the separating chamber 3 is of conical construction and actually has a substantially constant annular cross-section from top to bottom.

Finally, this separator also contains suitable means for delivering material for separation to the separating chamber 3. These delivery arrangements may be constructed in any suitable manner which is known per se. Thus in the present example (FIGS. 1 and 2) at least one of the separating air delivery channels 5, 6, 7, 8, but preferably at least one of the uppermost delivery channels (e.g. 5, 6) may also be constructed simultaneously for the delivery of material for separation by way of the inlet spiral 2 into the separating chamber 3. However, as an alternative or in addition thereto at least one material feed pipe connection 22 can be disposed in the upper housing cover wall 1*a*—as indicated by dash-dot lines in FIG. 1—wherein this material feed pipe connection opens above the upper annular plate 13*b*, which acts simultaneously as a material distributor plate, of the separator rotor 13 in such a way that the material for separation or a corresponding proportion of the material for separation can be introduced from above by way of this upper annular plate 13*b* into the annular separating chamber 3 so that it is evenly distributed over the circumference, and this uniformly distributed introduction can also be promoted or improved by a deflector ring which is indicated at 1*b* (FIG. 1) by dash-dot lines above the separating chamber 3.

With the details given above, the operation of this previously described separator should be quite clear for an illustration of the invention. The material for separation which is introduced in even distribution, preferably predominantly or completely, into the upper end of the separating chamber 3 is exposed to different turbulent motions in the different levels as it moves through this separating chamber 3, wherein these turbulent motions are produced by the different circumferential speeds of the separator rotor 13 at its various levels and can also be controlled by adjustable quantities of separating air in the delivery channels 5, 6, 7, 8 which lie one above the other, larger quantities of separating air being advantageously delivered to the upper levels of the separating chamber 3 than to the lower levels of the separating chamber 3. In this way several cut sizes are produced in the levels of the separating chamber 3 with a generally relatively broad or shallow grain size distribution and with a relatively high effectiveness of the separation in the separator.

Figure 4:
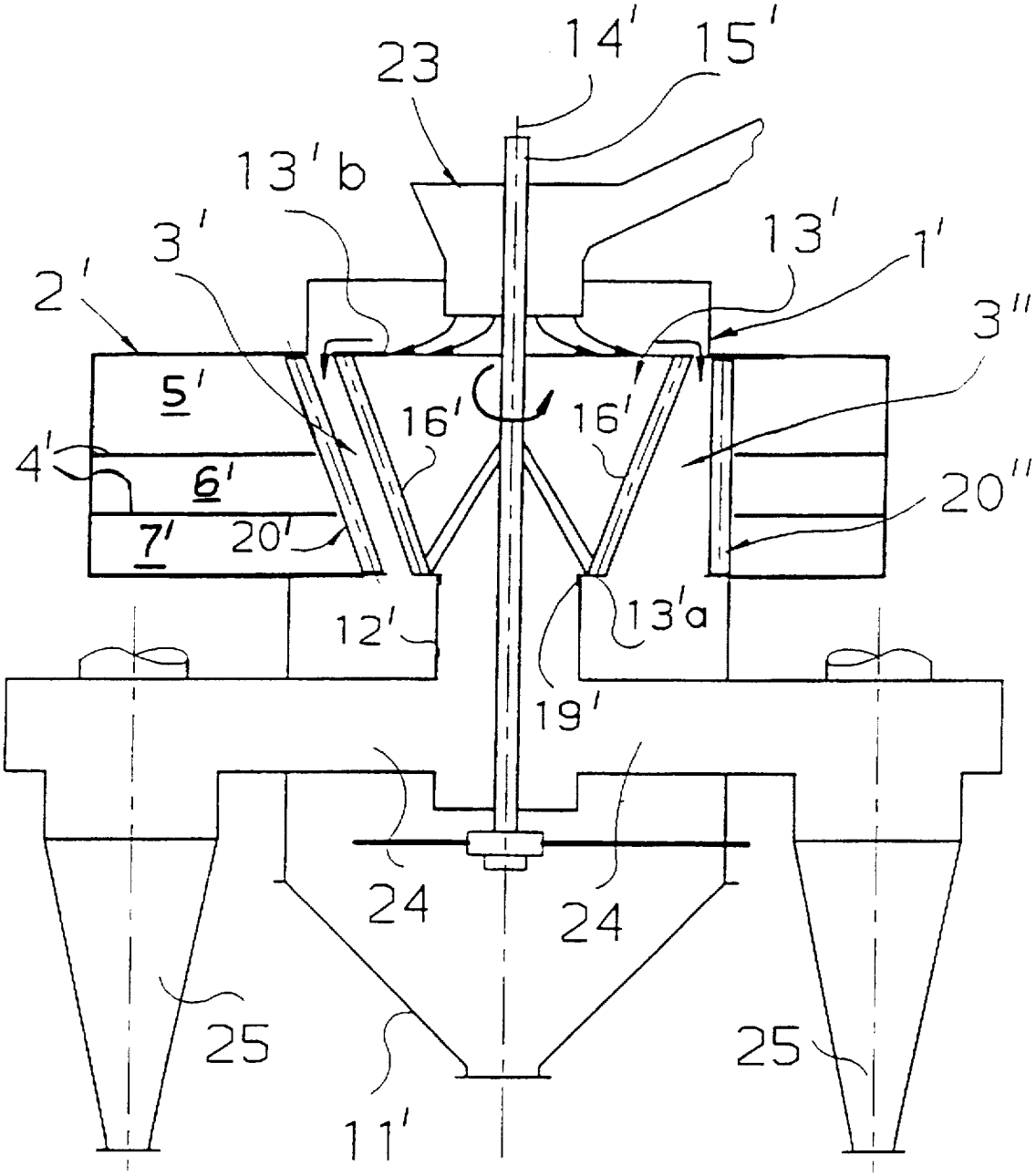
FIG. 4 shows a largely schematic vertical sectional view through a second embodiment of the separator, where two different variants of the configuration of the stationary guide vane ring are illustrated in the left-hand and the right-hand halves.

A further embodiment of the separator according to the invention is shown in FIG. 4, wherein the guide vane ring in the left-hand half of this FIG. 4 shows a variant with a conical guide vane ring (similar to FIG. 1) and in the right-hand half of FIG. 1 a second variant is shown with a substantially cylindrical guide vane ring with otherwise similar overall construction.

Since several parts of the example of the separator shown in FIG. 4 are similar in their basic operation and also to some extent in their basic construction to those which have been explained with reference to FIGS. 1 to 3, in this example according to FIG. 4 the same reference numbers are used with the addition of a prime for approximately the same components, so that the following explanation of this embodiment can be essentially confined only to the the real differences.

In FIG. 4 the separator also comprises a separator housing 1' with an inlet spiral 2' for the separating air which opens into the annular separating chamber 3' and is divided by two partitions 4' into three delivery channels which lie one above the other. The construction of the inlet spiral 2' can otherwise be constructed in the same way as is illustrated and explained with reference to FIG. 2; the same also applies to the provision of adjustable flaps 9 for setting the quantity of separating air delivered to the individual delivery channels 5', 6', 7'.

The separator rotor 13' again has a conical shape tapering downwards from the top with rotor blades 16' extending downwards and inwards. In the example according to FIG. 4 the rotor 13' which is rotatable about a vertical axis 14' and can be driven by means of its shaft 15' is closed off at its upper end by an upper cover plate 13'*b* which acts simultaneously as a material distributor plate and a bell-shaped distributor which serves to deliver material for separation opens concentrically above this upper cover plate so that the fresh material for separation can be delivered centrally onto the cover plate 13'*b* of the rotor 13' by way of this bell-shaped distributor 23, can be thrown outwards in even distribution by the rotary motion of the rotor 13' and can be introduced from above into the separating chamber 3'.

On its lower end face 13'*a* the separator rotor 13' has a sufficiently large central opening 19' through which the separating air laden with fine material is guided centrally downwards into a pipe connection 12' disposed there which for its part is connected by way of a plurality of pipes 24 to fine material precipitators 25 disposed outside the separator housing 1.

In this case the separator housing 1' also has a tailings discharge hopper 11' at its lower end for discharging the tailings.

Furthermore, according to FIG. 4 the separator rotor 13' again is concentrically surrounded with a radial clearance by a guide vane ring which is disposed stationary in the separator housing 1'. According to the left-hand variant in FIG. 4, the guide vane ring 20'—similar to the embodiment according to FIG. 1—is also of conical construction (tapering downwards), whilst the guide vane ring 20" in the right-hand half of FIG. 4 is substantially cylindrical. Accordingly the separating chamber 3' formed in the left-hand variant of FIG. 4 has an annular cross-section which remains constant from top to bottom—as illustrated by FIG. 1. By contrast, in the variant according to the right-hand half of the drawing in FIG. 4, the separating chamber 3" formed between the rotor blades 16' and the guide vane ring 20" has an annular cross-section which becomes uniformly larger from top to bottom. Although both variants can achieve the object of this invention in an advantageous manner, the left-hand variant in FIG. 4 offers the further advantage that the cut sizes in the different levels of the separating chamber 3' can be set and varied more exactly; in the right-hand variant in FIG. 4, on the other hand, the cylindrical guide vane ring 20" can be produced somewhat more simply.

A further difference in the embodiment illustrated in FIG. 4 may be seen in the fact that at least the upper delivery channel 5' of the inlet spiral 2' for the separating air can have a greater internal cross-section than the lower delivery channels 6', 7'. This construction of the individual separating air delivery channels 5', 6' 7' offers a further possibility for delivering larger quantities of separating air in the necessary manner to the upper levels of the separating chamber 3' than to the lower levels. Nevertheless it is considered advantageous that all delivery channels 5', 6', 7' are again each equipped with individually adjustable setting flaps 9 for adjustable quantities of air in a similar manner to that explained above with reference to FIGS. 2 and 3.

In support of the inventive idea for the newly proposed separator some series of tests were carried out in which in a cement grinding installation containing a material bed roll mill as comminuting assembly the same comminuted products were classified on the one hand in a conventional high-capacity separator according to DE-C-36 22 413 (with cylindrical separator rotor and separating chamber) and on the other hand in a separator constructed according to the present invention. Samples were taken of the fine material products, that is to say the finished cements, discharged from the two separators which are to be compared, and these samples were examined by the usual screen analyses. The results of two typical screen analyses are reproduced in the diagram shown in FIG. 5 (a so-called RRS diagram which is known per se) with the aid of two curves In this case curve I (solid line) represents the grain size distribution of the fine material from the conventional separator (according to DE-C-36 22 413) and curve II (dash-dot line) represents a typical grain size distribution in the fine material from the separator designed according to the invention.

Figure 5:
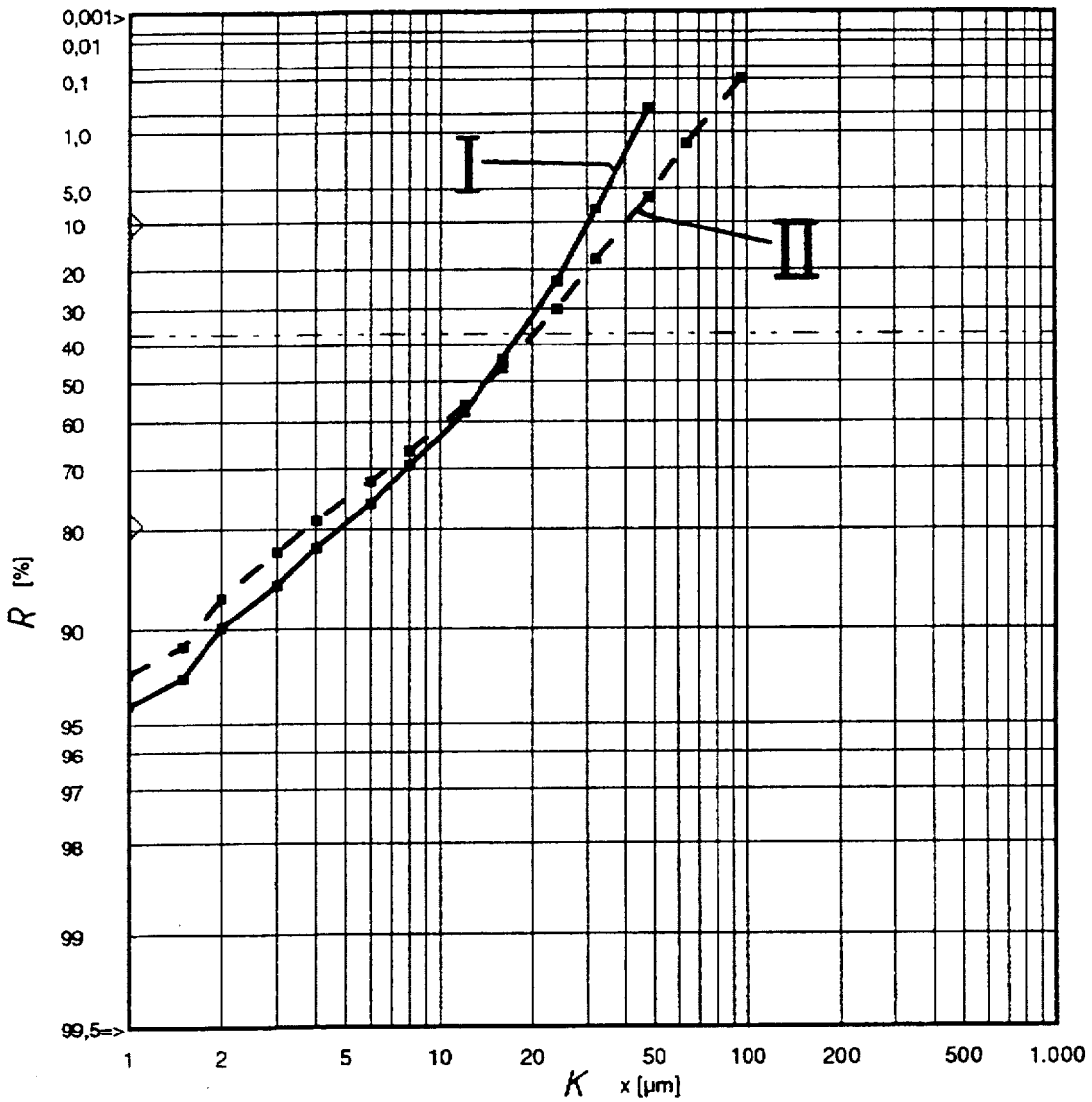
FIG. 5 shows a diagram with two grain size distribution curves as comparison between a known separator and the separator according to the invention.

In the diagram according to FIG. 5 the individual screen residues R determined in the screen analyses of the samples are plotted in % in the ordinate, whilst the abscissa gives the grain size K in μm. The two curves I and II plotted in the diagram for the two chosen samples make it clear that the sample of fine material or finished material taken from the conventional separator had a steeper grain size distribution and thus a narrower grain size range than the sample of finished material taken from the separator designed according to the invention which—according to curve II—demonstrates a broader or shallower grain size distribution and thus a broader grain size range in the finished product (cement).

We claim:

1. A separator comprising a housing having a relatively coarse material outlet and a relatively fine material outlet; a spiral separating air inlet having a plurality of vertically separate channels opening substantially tangentially into said housing, air guide vanes forming a cylindrical ring having passageways in communication with all of the channels of said air inlet; a substantially conical, basket-shaped separator rotor mounted in said housing for rotation about a substantially vertical axis and being radially spaced inwardly of said ring thereby forming an annular conical separating chamber encircling said rotor and occupying a position between said ring and said rotor, said rotor having a plurality of circumferentially spaced, downwardly and radially inwardly inclined blades forming air passages from said separating chamber into said rotor, said rotor, said separating chamber, and said air inlet being of substantially uniform height; means for supplying material to be separated to said separating chamber; and means for delivering separating air via the channels of said inlet and said passageways of said annular ring into said separating chamber and thence via said air passages into said rotor for discharge of relatively coarser particles of material through the coarse material outlet and relatively finer material particles through said fine material outlet, the substantial uniformity in height of said rotor, said separating chamber, and said air inlet enabling all of said separating air to enter said separating chamber.

2. The separator according to claim 1 wherein the delivery channels of said inlet are of substantially uniform cross sectional area.

3. The separator according to claim 1 wherein that channel which is uppermost has a cross sectional area greater than any other of said channels.

4. The separator according to claim 1 including volume adjusting means in communication with each of said channels for adjusting the volume of air delivered from each of said channels to said separating chamber.

5. The separator according to claim 4 wherein said volume adjusting means comprise vertically spaced vanes.

6. The separator according to claim 1 including volume adjusting means in communication with each of said passages for adjusting the volume of air delivered from said separating chamber to said rotor.

7. The separator according to claim 6 wherein said volume adjusting means comprise vertically spaced vanes.

8. The separator according to claim 1 wherein said inlet has at least three of said channels located one above the other.

9. The separator according to claim 1 wherein said inlet has at least four of said channels located one above the other.

10. The separator according to claim 1 wherein said rotor has at its upper end a material distributor plate to which material from said material supplying means is delivered, said distributor plate distributing said material to said separating chamber in response to rotation of said rotor.

11. The separator according to claim 1 wherein said annular ring has individual guide vanes adjustable to vary the quantity of air passing from said inlet through said annular ring.

12. The separator according to claim 1 wherein said rotor has adjustable blades for varying the size of said passages and the volume of air and material which may pass from said separating chamber into said rotor.

* * * * *

UNITED STATES PATENT AND TRADEMARK OFFICE

CERTIFICATE OF CORRECTION

PATENT NO. : 5,791,490

DATED : August 11, 1998

INVENTOR(S) : Otto Heinemann, Ingo Engeln, Hubert Eickholt, Ludger Lohnherr, Michael von Seebach and Ludger Schulte It is certified that error appears in the above-indentified patent and that said Letters Patent is hereby corrected as shown below:

On the title page, delete the Abstract, and insert the following:

ABSTRACT

A separator for separating relatively fine and relatively coarse material has a housing within which is a downwardly tapering, substantially conical, basket-shaped rotor encircled by and spaced from a guide vane ring which, together with the rotor, forms a separating chamber. Separating air is delivered by a spiral inlet through the guide vane ring into the seperating chamber and material to be separated is delivered to the separating chamber where it is entrained by the separating air and delivered into the rotor. The air inlet has a plurality of vertically spaced channels of the same or different cross-sectional area t eby enabling different volumes of air to be delivered to different levels of the separating chamber. Adjustable vanes carried by the inlet enable volumetric control of the air to be achieved.

UNITED STATES PATENT AND TRADEMARK OFFICE

CERTIFICATE OF CORRECTION

PATENT NO. : 5,791,490
DATED : August 11, 1998
INVENTOR(S) : Otto Heinemann, et al.

It is certified that error appears in the above-identified patent and that said Letters Patent is hereby corrected as shown below:

Column 4, line 65, change "arrangements" to -- means --.

Signed and Sealed this

Twenty-ninth Day of December, 1998

*Attest:*

*Attesting Officer*

Bruce Lehman

BRUCE LEHMAN

*Commissioner of Patents and Trademarks*